US010282945B2

(12) United States Patent
De Knijff

(10) Patent No.: US 10,282,945 B2
(45) Date of Patent: May 7, 2019

(54) WAGERING PLATFORM

(71) Applicant: Metric Gaming LLC, Las Vegas, NV (US)

(72) Inventor: Martin De Knijff, Las Vegas, NV (US)

(73) Assignee: Metric Gaming LLC, Las Vegas, NV (US)

( * ) Notice: Subject to any disclaimer, the term of this patent is extended or adjusted under 35 U.S.C. 154(b) by 115 days.

(21) Appl. No.: 15/320,614

(22) PCT Filed: Jun. 25, 2015

(86) PCT No.: PCT/US2015/037801

§ 371 (c)(1),
(2) Date: Dec. 20, 2016

(87) PCT Pub. No.: WO2015/200703

PCT Pub. Date: Dec. 30, 2015

(65) Prior Publication Data

US 2017/0206742 A1 Jul. 20, 2017

Related U.S. Application Data

(60) Provisional application No. 62/017,478, filed on Jun. 26, 2014.

(51) Int. Cl.
*G07F 17/32* (2006.01)

(52) U.S. Cl.
CPC ..... *G07F 17/3262* (2013.01); *G07F 17/32* (2013.01); *G07F 17/323* (2013.01); *G07F 17/3288* (2013.01)

(58) Field of Classification Search
USPC ..... 463/25
See application file for complete search history.

(56) References Cited

U.S. PATENT DOCUMENTS

2004/0059655 A1* 3/2004 Seifert ..... G06Q 10/04 705/35
2005/0003881 A1* 1/2005 Byng ..... 463/16
2007/0088661 A1* 4/2007 De Verdier ..... G06Q 50/188 705/80
2010/0022289 A1* 1/2010 Menicou ..... A63F 13/12 463/14

OTHER PUBLICATIONS

International Search Report Issued in PCT/US2015/037801 dated Sep. 23, 2015.

* cited by examiner

*Primary Examiner* — Pierre E Elisca
(74) *Attorney, Agent, or Firm* — Mintz Levin Cohn Ferris Glovsky and Popeo, P.C.

(57) ABSTRACT

A wagering platform is described that enables bettors to wager on more games than their budgets or account balances would otherwise allow, without extending them credit and without sacrificing the house advantage. The platform allows the bettor to select a plurality of wagers and designates the maximum amount he or she is willing to risk. Based on those inputs, the platform generates a wager amount that the bettor can stake on each selected wager (which will total more than the bettor's maximum risk amount). Related apparatus, systems, techniques and articles are also described.

12 Claims, 5 Drawing Sheets

WAGERING PLATFORM

CROSS-REFERENCES TO RELATED APPLICATIONS

The present application is a national stage entry, filed under 35 U.S.C. § 371, of and claims priority to International Application No. PCT/US2015/037801, filed on Jun. 25, 2015, which claims the benefit of and priority to U.S. Provisional Patent Application No. 62/017,478, filed Jun. 26, 2014. The entire contents of the above applications are incorporated herein by reference in their entireties and for all purposes.

CROSS-REFERENCE TO RELATED APPLICATION

This application claims the benefit of U.S. Provisional Patent Application No. 62/017,478, filed on Jun. 26, 2014, the contents of which are incorporated herein by reference in their entireties.

TECHNICAL FIELD

The subject matter described herein relates to a wagering/betting platform, and particularly, for a platform for wagering/betting on multiple events, such as sporting events.

BACKGROUND

In a traditional wagering platform, a bet or wager is placed on a future outcome such as the winner of a sporting event, and the amount of the wager is deducted from the bettor's account pending the outcome of the wager. Accordingly, the total amount a bettor can wager is typically limited to his or her account balance, and in many jurisdictions, extending credit to bettors (such that they can wager with borrowed money) is unlawful. Consequently, bettors interested in wagering on multiple games are often unable to do so due to budgetary or account balance restrictions.

SUMMARY

Variations of the present subject matter are directed to methods, systems, devices, and other articles of manufacture that are provided for wagering/betting. In some variations, methods, systems, devices, and other articles of manufacture are provided for wagering/betting on events, such as sporting events.

In some variations, a method for wagering on multiple events is provided, where the method includes receiving (1) multiple wager selections on multiple events and (2) a fixed budget amount (the "Risk Limit"), representing the total amount the bettor is willing to risk across all selected wagers. In some variations, based on these two inputs, the method calculates and generates an amount for each selected wager (the "Wager Amount"), which Wager Amounts, in the aggregate, total more than the bettor's designated Risk Limit. The method then allows the bettor to keep his or her winnings on each winning bet, as if the bettor had in fact wagered the Wager Amount on each selected bet, but losses are strictly limited to the bettor's designated Risk Limit, such that the bettor could never lose more than the Risk Limit. The Wager Amount is calculated such that the sportsbook offering this method does not lose (and in fact enhances) its theoretical house advantage.

The present subject matter provides a computer-implemented method that includes receiving wager data representing a plurality of wager selections for a plurality of events and a risk limit. Based at least in part on the wager data and the odds associated with each of the wager selections, a total wager amount is generated. The total wager amount is determined such that the maximum loss is less than or equal to the risk limit while having a greater wagering value than the risk limit. The total wager amount can be displayed to the user/bettor.

In some variations, the plurality of events include sporting events.

In some variations, the method also includes providing a user interface that includes a screen displaying the plurality of events for the wager selections, and a screen displaying the generated wager amount.

In some variations, the method also includes generating a respective wager amount for each of the wager selections and aggregating, by at least one processor, each of the respective wager amount to determine the total wager amount.

Non-transitory computer program products (i.e., physically embodied computer program products) are also described that store instructions, which when executed by one or more data processors of one or more computing systems, cause at least one data processor to perform operations herein. Similarly, computer systems are also described that may include one or more data processors and memory coupled to the one or more data processors. The memory may temporarily or permanently store instructions that cause at least one processor to perform one or more of the operations described herein. In addition, methods can be implemented by one or more data processors either within a single computing system or distributed among two or more computing systems. Such computing systems can be connected and can exchange data and/or commands or other instructions or the like via one or more connections, including but not limited to a connection over a network (e.g., the Internet, a wireless wide area network, a local area network, a wide area network, a wired network, or the like), via a direct connection between one or more of the multiple computing systems, etc.

The subject matter described herein provides many advantages. For example, by providing the bettor with the opportunity to set a cap on his or her losses—while at the same time wagering on more games than the bettor otherwise could have afforded—bettors will have a more exciting and enjoyable betting experience and are more likely to feel fulfilled by their wagering sessions while sticking to their wagering budgets. For sportsbook operators, their theoretical advantage actually increases, because bettors are wagering more than they otherwise would have without the wagering platform described herein. Indeed, the additional risk an operator assumes by capping a bettor's losses would be—to a mathematical certainty—more than offset by the theoretical value of e corresponding increase in total wager amounts.

DESCRIPTION

The current subject matter provides a wagering platform that enables the bettor to wager on more events (for example, sporting events) for a greater amount than his or her budget or account balance would otherwise allow, while nevertheless maintaining (and enhancing) the sportsbook's theoretical edge.

In some variations, the current subject matter provides a platform, a gaming system, and method, for example, in which an individual (bettor) can select as many events for wagering as he or she would like and designate a maximum amount that the bettor is willing to risk, and be able to wager a total amount across all selected wagers that is greater than the total amount the bettor is willing to risk, while keeping all winnings from those wagers but having losses strictly capped at the maximum risk amount specified.

For example, a bettor selects wagers from as many events as he or she would like from a list of events available for wagering. The bettor is then prompted to input a maximum amount that he or she is willing to risk on the selected wagers (the "Risk Limit"). Based on the total number of events selected and the designated Risk Limit, the bettor is presented with an amount that he or she can wager on each game (the "Wager Amount"), which Wager Amounts (across all selected events) will total more than the bettor's Risk Limit. The bettor can then accept the proposed Wager Amount and enjoy every selected event as if he or she had in fact wagered the Wager Amount on each such event, and keep any and all winnings resulting from those wages. No matter how many of those wagers lose, however, the bettor's maximum loss will be strictly capped at the Risk Limit, such that the bettor can never lose more than his or her Risk Limit.

In some variations, the Wager Amount can be determined based on one or more factors including, for example, (i) the total number of events selected for wagering; (ii) the pre-game odds of each wager selected; and (iii) the Risk Limit designated by the bettor. In some variations, the Wager Amount can be processed based on one or more special algorithms based on quantitative analytics of sports data, for example, internally on a specially configured betting server, or communicated externally via APIs (Application Programming Interface) to a third party (which processes the information and sends back the Wager Amount also via an API).

In some variations, the designated Risk Limit can be deducted from the bettor's wagering account, pending the outcome of all selected wagers.

Figure 1A:
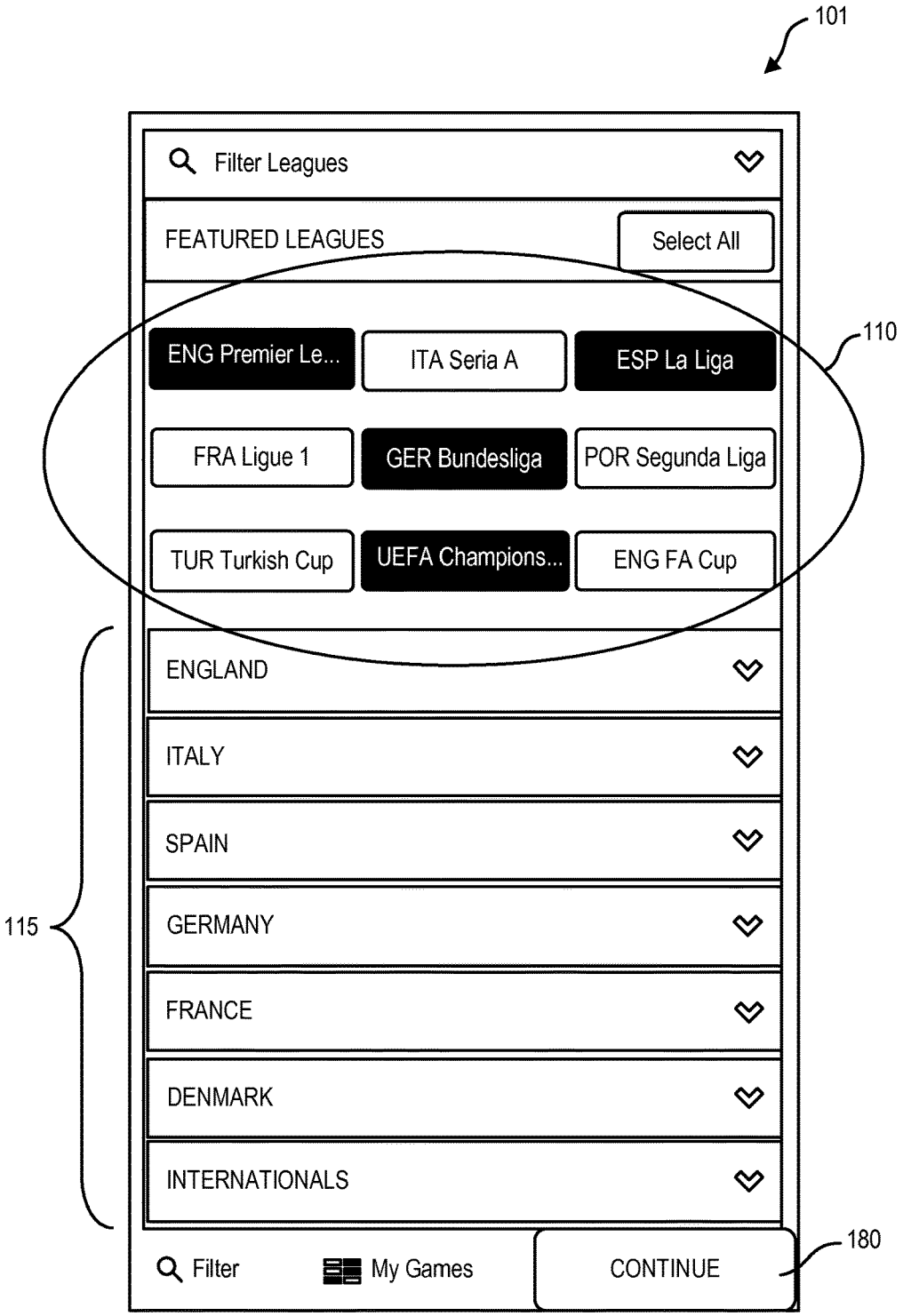
FIGS. 1A-1C are screenshots of an example of a graphical user interface showing features in accordance with variations of the current subject matter.
Figure 1B:
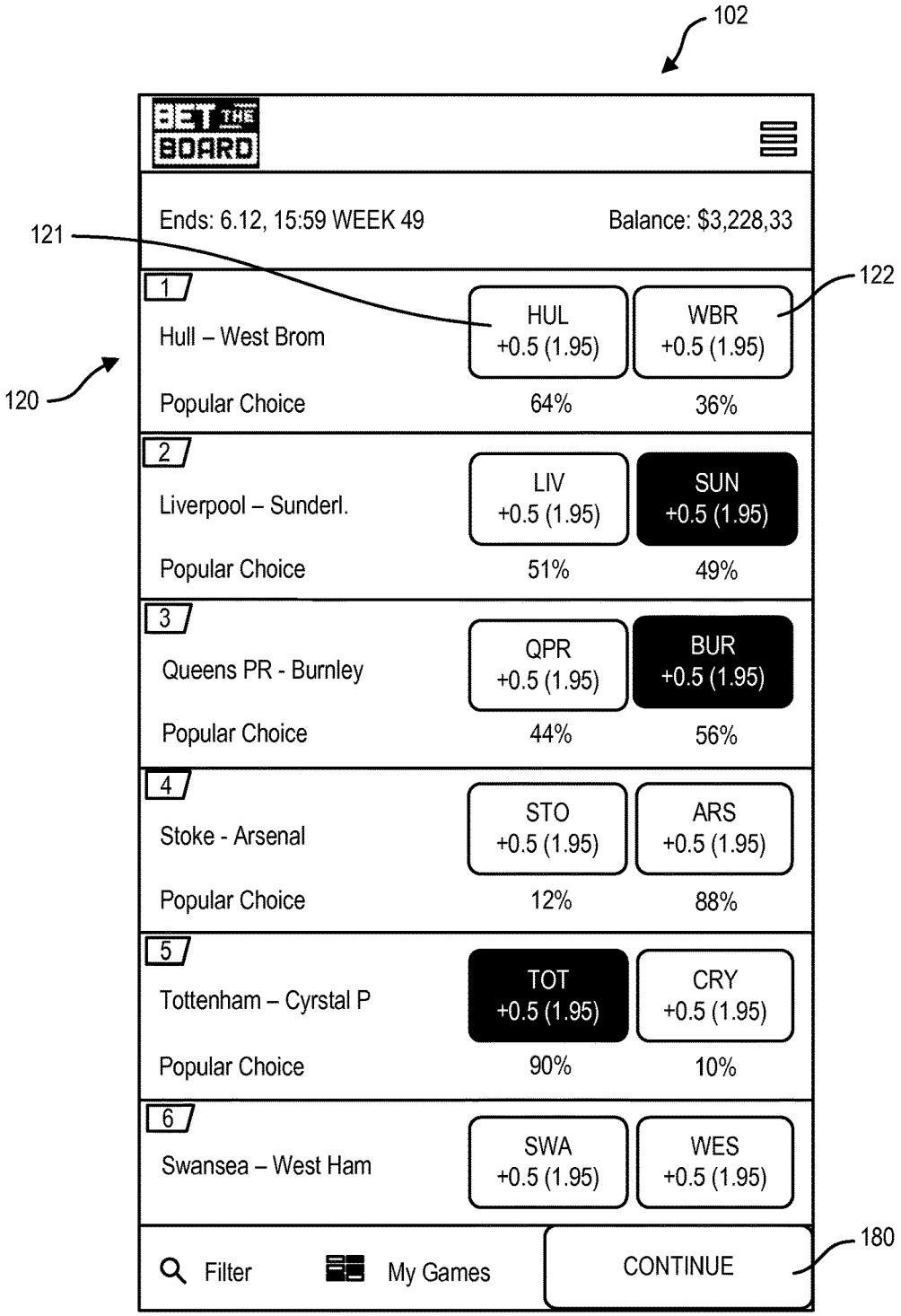
Figure 1C:
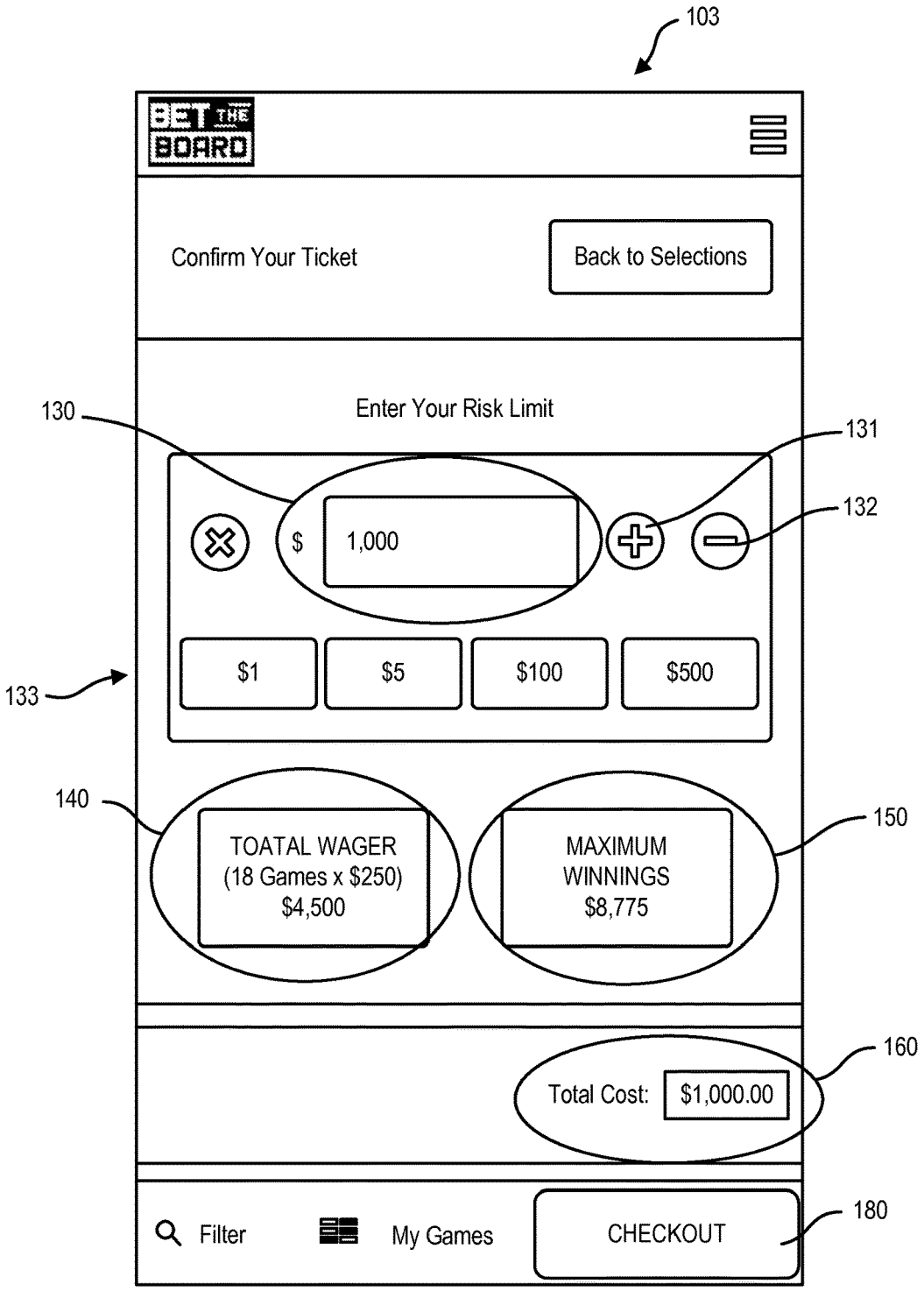

FIGS. 1A-1C are screenshots of an example of a graphical user interface displaying features in accordance with variations of the current subject matter. Referring FIG. 1A, the bettor is presented with screen 101, which provides a menu 110 from which to select various sports leagues (here, soccer leagues are provided as examples for illustration purposes only). Each league can be represented by a button (for example) for bettor selection. In this example, different European and International leagues are presented using buttons and drop-down menus. These are provided for illustration purposes only; other graphical features can be used. Here, the user has selected 4 leagues (designated by the blue-highlighted/darkened buttons), but different number and combinations of selections are possible. Once the user has selected the league(s), the user can select the "CONTINUE" button 180 to continue with the betting process.

Based on the selection(s) using screen 101, the platform can generate screen 102 (which s depicted in FIG. 1B) in which the sporting events associated with the selected leagues are presented. In this example, events associated with the selected league(s) are shown (120) along with the betting odds for each team and the ability to select the desired wagers using buttons 121 and 122 (for example) for each event/match. Here, the bettor has selected three wagers (designated by the blue-highlighted/darkened buttons), but any number and combinations of wagers are possible.

Based on the selected wagers, the platform generates screen 103 (see FIG. 1C) in which the bettor is presented with the opportunity to input a Risk Limit 130 (here $1,000), which can be adjusted using, for example, buttons 131 and 132, and increment buttons 133. In this example, the interface has generated a Wager Amount of $250, which is applied to each of the selected wagers (here, a total of 18) for a total wager amount of $4,500 (140). The maximum potential win amount 150 (here, $8,775) is also listed, as well as the total cost (i.e., the Risk Limit 130), representing the amount to be deducted from the bettor's wagering account pending the outcome of the selected wagers.

Figure 2:
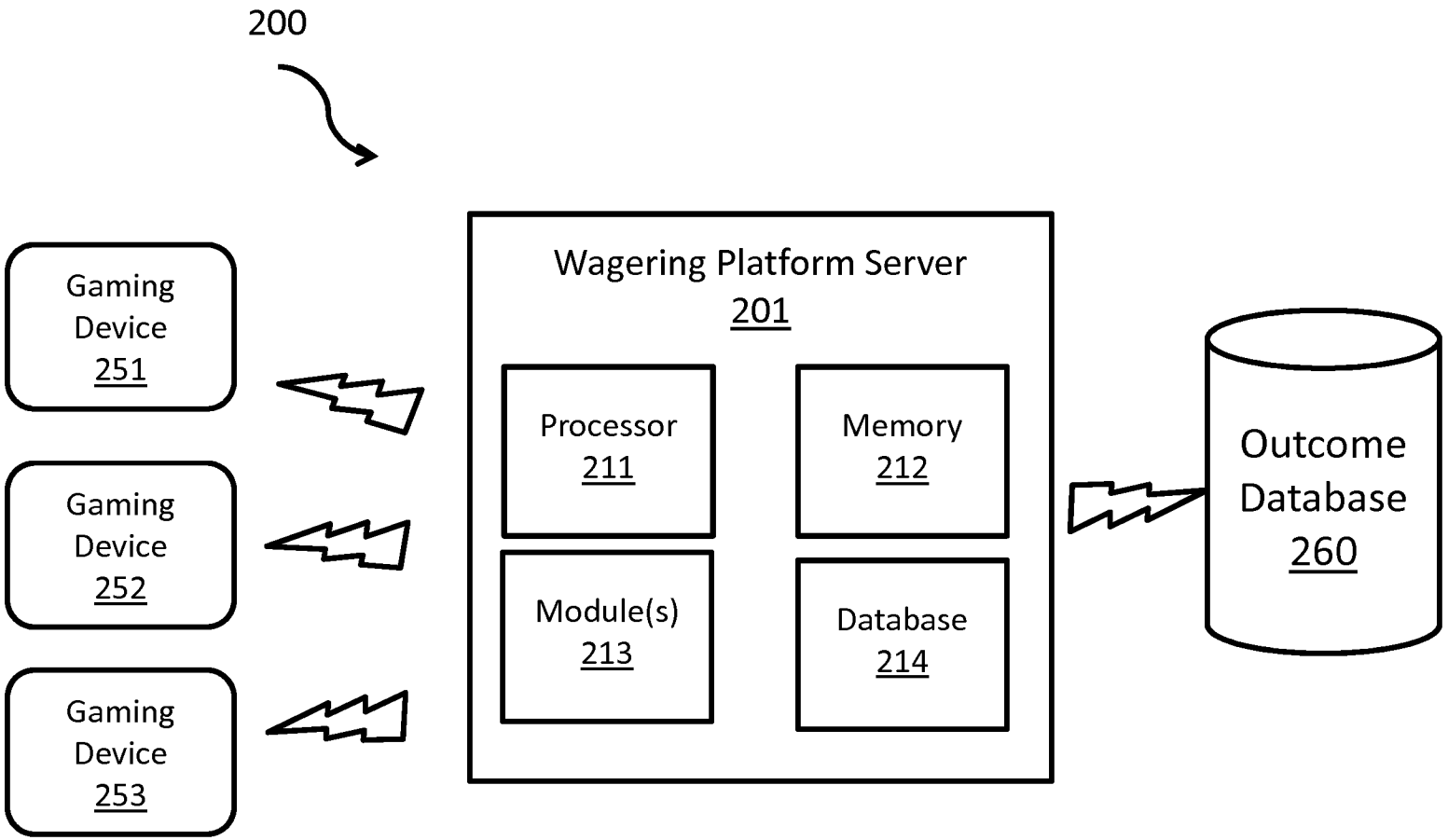
FIG. 2 is a diagrammatic view of a wagering platform in accordance with a variation of the current subject matter.

FIG. 2 shows an example of a computer-implemented system in accordance with the current subject matter. Here, the wagering platform/system 200 includes a wagering platform server 201 in communication (e.g., through APIs) with one or more gaming device 251-253 and an outcome database 260. The server 201 includes one or more processors 211, memories 212, modules 213, and databases 214. The one or more modules 213 can be configured with instructions that when executed by the one or more processors 211, performs one or more features of the wagering platform discussed herein including, for example, generating a Wager Amount. The outcome database 260 can be configured to store the outcomes of various gaming events on which bets can be/have been placed. In some variations, the outcome database 260 is implemented within database 214 of the wagering platform server 201.

In some variations, the gaming devices 251-253 can be, for example, smart phones, tablets, PCs, or dedicated gaming machines. These devices preferably each include a display and an input device. These devices can be configured to generate one or more betting data based on input by the bettors, and send the betting data to the server 201. These devices can also be configured to receive one or more gaming data and/or betting options from the server 201, to be displayed to the bettors via, for example, a user interface as discussed herein.

In some variations, one of more of gaining devices can be configured to be operated by a local agent such as a teller, for example, at a counter or kiosk in a betting shop (or casino). The gaming devices can be operationally connected to a printer to print a wager ticket, for example, that lists all wagers that the bettor has in play as well as the Wager Amount for each wager and the Risk Limit.

Figure 3:
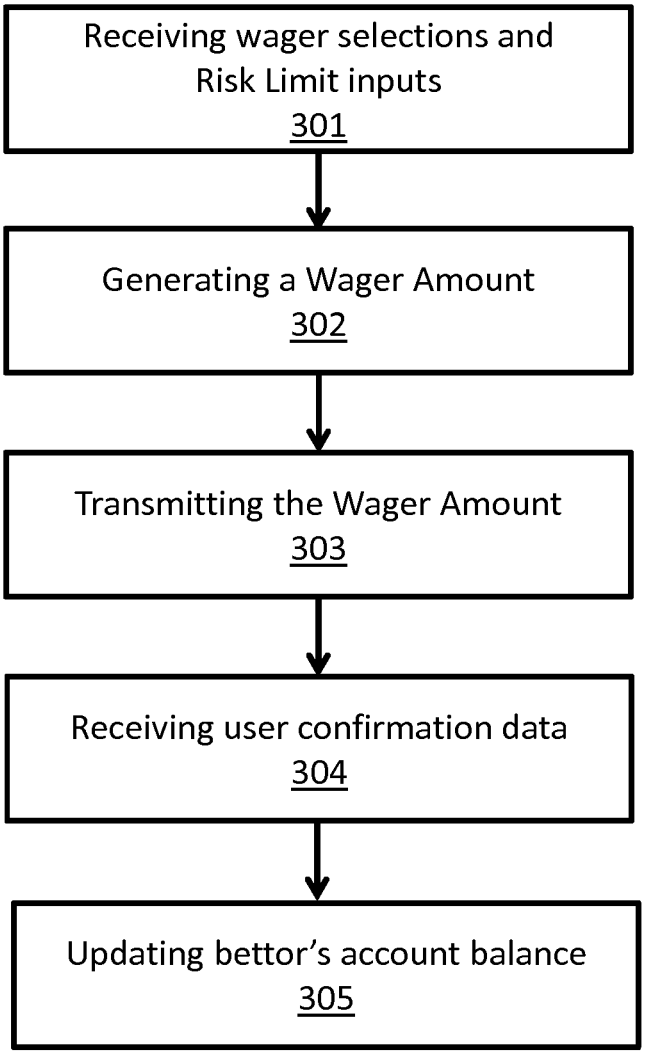
FIG. 3 is a process flow diagram showing features in accordance with variations of the current subject matter.

FIG. 3 illustrates a process flow of an example of the wagering platform in accordance with the current subject matter. In some variations, the bettor can designate the desired wagers and the Risk Limit (e.g., using a gaining device), which parameters are received by the server at 301.

At 302, the server generates a Wager Amount based on, for example, the wagers selected and the Risk Limit designated, or a combination thereof. This can be done, for example, based on a special algorithm based on quantitative analytics of sporting events.

At 303, the Wager Amount is transmitted to the gaming device to be displayed to the bettor. If the bettor accepts the Wager Amount, the Risk Limit can be deducted from the bettor's account, or the bettor can pay the Risk Limit via, for example, a teller or an automated kiosk. Once the user confirms the wagers, that data is generated and transmitted to the server, which is received at 304.

As each wagered game is completed, the server will calculate the results of the bettor's wagers and update the bettor's account balance accordingly, with any losses from the selected wagered strictly capped at the Risk Limit.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to as programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for ample magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example as would a processor cache or other random access memory associated with one or more physical processor cores.

To provide for interaction with a user, one or more aspects or features of the subject matter described herein can be implemented on a computer having a display device, such as for example a cathode ray tube (CRT) or a liquid crystal display (LCD) or a light emitting diode (LED) monitor for displaying information to the user and a keyboard and a pointing device, such as for example a mouse or a trackball, by which the user may provide input to the computer. Other kinds of devices can be used to provide for interaction with a user as well. For example, feedback provided to the user can be any form of sensory feedback, such as for example visual feedback, auditory feedback, or tactile feedback; and input from the user may be received in any form, including, but not limited to, acoustic, speech, or tactile input. Other possible input devices include, but are not limited to, touch screens or other touch-sensitive devices such as single or multi-point resistive or capacitive trackpads, voice recognition hardware and software, optical scanners, optical pointers, digital image capture devices and associated interpretation software and the like.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." In addition, use of the term "based on," above and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For example, the implementations described above can be directed to various combinations and subcombinations of the disclosed features and/or combinations and subcombinations of several further features disclosed above. In addition, the logic flows depicted in the accompanying figures and/or described herein do not necessarily require the particular order shown, or sequential order, to achieve desirable results. Other implementations may be within the scope of the following claims.

What is claimed is:

1. A computer-implemented method comprising:

receiving, by at least one processor, a wager data representing a plurality of wager selections for a plurality of events and a risk limit;

generating, by the at least one processor, an individual wager amount corresponding to a wager for each sporting event selected using the one more graphical features, displayed on a user interface generated by the at least one processor, and a total wager amount corresponding to all wagers for all sporting events selected using the one or more graphical features, the individual wager amounts and the total wager amount are generated based on a total number of sporting events selected using the one or more graphical features, on the wager data and pre-sporting-event odds associated with each sporting event selected using the one or more graphical features, and the received risk limit amount, the total wager amount is greater than the received risk limit amount;

transmitting, by the at least one processor, the generated wager amount to be displayed to a user.

2. The computer-implemented method according to claim 1, wherein the plurality of events include sporting events.

3. The computer-implemented method according to claim 1, further comprising providing, by the at least one processor, a user interface including a screen displaying the plurality of events for the wager selections, and a screen displaying the generated wager amount.

4. The computer-implemented method according to claim 1, further comprising generating, by the at least one processor, a respective wager amount for each of the wager selections; and aggregating, by the at least one processor, each of the respective wager amount to determine the total wager amount.

5. A non-transitory computer readable medium storing instructions, which when executed by at least one data processor of at least one computing system, result in operations comprising:

receiving, by at least one processor, a wager data representing a plurality of wager selections for a plurality of events and a risk limit;

generating, by the at least one processor, an individual wager amount corresponding to a wager for each sporting event selected using the one more graphical features, displayed on a user interface generated by the at least one processor, and a total wager amount corresponding to all wagers for all sporting events selected using the one or more graphical features, the individual wager amounts and the total wager amount are generated based on a total number of sporting events selected using the one or more graphical features, pre-sporting-event odds associated with each sporting event selected using the one or more graphical features, and the received risk limit amount, the total wager amount is greater than the received risk limit amount; and transmitting, by the at least one processor, the generated wager amount to be displayed to a user.

6. The non-transitory computer readable medium according to claim 5, wherein the plurality of events include sporting events.

7. The non-transitory computer readable medium according to claim 5, wherein the operations further comprise providing, by the at least one processor, a user interface including a screen displaying the plurality of events for the wager selections, and a screen displaying the generated wager amount.

8. The non-transitory computer readable medium according to claim 5, wherein the operations further comprise generating, by the at least one processor, a respective wager amount for each of the wager selections; and aggregating, by the at least one processor, each of the respective wager amount to determine the total wager amount.

9. A system comprising:

at least one processor; and memory storing instructions which, when executed by the at least one data processor, result in operations comprising:

receiving, by the at least one processor, a wager data representing a plurality of wager selections for a plurality of events and a risk limit;

generating, by the at least one processor, an individual wager amount corresponding to a wager for each sporting event selected using the one more graphical features, displayed on a user interface generated by the at least one processor, and a total wager amount corresponding to all wagers for all sporting events selected using the one or more graphical features, the individual wager amounts and the total wager amount are generated based on a total number of sporting events selected using the one or more graphical features, pre-sporting-event odds associated with each sporting event selected using the one or more graphical features, and the received risk limit amount, the total wager amount is greater than the received risk limit amount; and transmitting, by the at least one processor, the generated wager amount to be displayed to a user.

10. The system according to claim 9, wherein the plurality of events include sporting events.

11. The system according to claim 9, wherein the operations further comprise providing, by the at least one processor, a user interface including a screen displaying the plurality of events for the wager selections, and a screen displaying the generated wager amount.

12. The system according to claim 9, wherein the operations further comprise generating, by the at least one processor, a respective wager amount for each of the wager selections; and aggregating, by the at least one processor, each of the respective wager amount to determine the total wager amount.

* * * * *